US007445320B2

(12) United States Patent
Jung et al.

(10) Patent No.: US 7,445,320 B2
(45) Date of Patent: Nov. 4, 2008

(54) INK CARTRIDGE FOR INK-JET PRINTER

(75) Inventors: Myung-song Jung, Gyeonggi-do (KR); Young-su Lee, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 25 days.

(21) Appl. No.: 10/745,664

(22) Filed: Dec. 29, 2003

(65) Prior Publication Data

US 2004/0141035 A1 Jul. 22, 2004

(30) Foreign Application Priority Data

Jan. 3, 2003 (KR) ..... 10-2003-0000376

(51) Int. Cl.
*B41J 2/175* (2006.01)

(52) U.S. Cl. ..... 347/86; 347/85; 347/87

(58) Field of Classification Search ..... 347/86, 347/87

See application file for complete search history.

(56) References Cited

U.S. PATENT DOCUMENTS 6,260,961 B1 * 7/2001 Seu et al. ..... 347/87
6,766,817 B2 7/2004 Elson Silva
6,893,120 B2 * 5/2005 Bailey et al. ..... 347/87

FOREIGN PATENT DOCUMENTS

JP 10-181036 7/1998

OTHER PUBLICATIONS

Korean Office Action for Korean Application No. 10-2003-0000376.

* cited by examiner

*Primary Examiner*—Matthew Luu
*Assistant Examiner*—Brian J Goldberg
(74) *Attorney, Agent, or Firm*—Staas & Halsey LLP

(57) ABSTRACT

A multi-chamber ink cartridge for an ink-jet printer, the ink cartridge including a printhead to eject ink droplets on a printing medium; a unitary body comprising: first, second and third ink chambers formed by "T"-shaped vertical walls in the unitary body, and first, second, and third ink channels respectively connected to a lower portion of each of the ink chambers to supply ink to the printhead; and a flexible printed circuit to apply an electrical signal to nozzles of the printhead; wherein the first chamber is disposed perpendicular to the second chamber and the third chamber, and the printhead is disposed on a lower portion of the unitary body which corresponds to the second and third chambers.

9 Claims, 6 Drawing Sheets

INK CARTRIDGE FOR INK-JET PRINTER

CROSS-REFERENCE TO RELATED APPLICATIONS

This application claims the priority of Korean Patent Application No. 2003-376, filed on Jan. 3, 2003, in the Korean Intellectual Property Office, the disclosure of which is incorporated herein in its entirety by reference.

BACKGROUND OF THE INVENTION

1. Field of the Invention

The present invention relates to an ink cartridge for an ink-jet printer, and, more particularly, to an ink cartridge for an ink-jet printer in which ink channels from three ink chambers to one printhead are fabricated in a unitary body in an ink cartridge body.

2. Description of the Related Art

In general, an ink cartridge for an ink-jet printer stores ink and ejects ink droplets through a printhead in order to print an image of a predetermined color on paper. In the ink cartridge, it is very important to arrange ink channels to be connected from ink chambers, in which ink of three colors is stored, to a printhead, so that the ink moves from the ink chambers to the printhead during a color printing operation. In a conventional method of fabricating an ink cartridge, an ink cartridge having multiple chambers is fabricated by combining a plurality of plastic components.

However, in the conventional method for fabricating an ink cartridge by assembling a plurality of components, the number of components and the number of assembling processes are increased. As a result, fabrication costs increase.

In order to solve this problem, an ink cartridge formed as a unitary body is disclosed in U.S. Pat. No. 6,260,961.

Referring to FIG. 1, an ink cartridge 10 includes first, second, and third chambers 13, 14, and 15, which are separated by "T"-shaped interior walls 11 and 12. Each of the first, second, and third chambers 13, 14, and 15 stores ink of a different color. Reference numeral 16 denotes a sealing member for sealing an opening into which a side core is inserted for injection molding of the unitary body ink cartridge 10.

FIG. 2 is a cross-sectional view illustrating the lower structure of a second or third chamber of FIG. 1. Ink stored in the second chamber 14 is supplied to an ink feed slot 24 through an ink outlet port 22 and a filter (not shown) installed on a standpipe 21. That is, ink stored in the second chamber 14 flows along an ink flow path indicated by an arrow 23. A printhead is installed under the ink outlet port 22. The printhead receives ink supplied from the ink outlet port 22, and ejects ink, through nozzles (not shown), in the shape of ink droplets.

FIG. 3 is a cross-sectional view illustrating the lower structure of the first chamber 13.

Referring to FIGS. 1 through 3, ink stored in the first chamber 13 passes through an opening 33 and a vertical ink channel 34 in a standpipe 31, and is supplied to an ink feed slot 35. Ink passing through the ink feed slot 35 is supplied to the nozzles of the printhead.

In a conventional ink cartridge 10 having the above structure, in order to injection mold the ink cartridge 10 as a unitary body, a side core, which is a mold for molding the ink flow path including an ink channel formed under the ink cartridge 10, is required. The side core has a slanted structure so as to be easily inserted into or removed from the mold forming the ink cartridge 10. A sealing member 16 is sealed in an opening of the ink cartridge 10, through which the side core is inserted into or removed from, by adhesive or by ultrasonic welding. If the sealing member 16 is not precisely combined with the ink cartridge 10, interference with interconnection and contact points of a flexible printed circuit (FPC) (not shown) attached on the printhead of the ink cartridge 10 occurs. Thus, an operation of transmitting an electrical signal to the printhead is disturbed. As a result, printing quality is lowered.

In addition, when inks of different colors are supplied to the printhead through two long ink flow paths 23 from the second and third chambers 14 and 15 as in the conventional ink cartridge, the sealing member 16 should prevent the inks from leaking out of the ink flow paths 23, and should prevent leaks between the adjacent ink flow paths 23. Thus, the internal structure of the side core and the sealing member 16 becomes complicated. In addition, when sealing using the sealing member 16 is incomplete, color mixture may occur due to leaks between the ink flow paths 23.

SUMMARY OF THE INVENTION

The present invention provides an ink cartridge for an ink-jet printer which effectively supplies ink stored in an ink chamber to a printhead by improving the arrangement of ink channels.

Additional aspects and/or advantages of the invention will be set forth in part in the description which follows and, in part, will be obvious from the description, or may be learned by practice of the invention.

According to an aspect of the present invention, there is provided a multi-chamber ink cartridge for an ink-jet printer, the ink cartridge including a printhead to eject ink droplets on a printing medium; a unitary body comprising: first, second, and third ink chambers formed by "T"-shaped vertical walls in the unitary body, and first, second, and third ink channels respectively connected to a lower portion of each of the ink chambers to supply ink to the printhead; and a flexible printed circuit to apply an electrical signal to nozzles of the printhead. The first chamber is disposed perpendicular to the second chamber and third third chamber, and the printhead is disposed on a lower portion of the unitary body which corresponds to the second and third chambers.

The first ink channel, provided to supply ink from the first chamber to the printhead, may be disposed parallel to a lengthwise direction of the second or third chamber.

The ink cartridge may further include a sealing member to seal an opening through which a side core is inserted during injection molding to form the ink channels and removed after the injection molding, wherein the sealing member is disposed in a region not in contact with the flexible printed circuit.

The second and third ink channels, provided to supply ink from the second and the third chambers, respectively, to the printhead, are substantially vertically formed.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
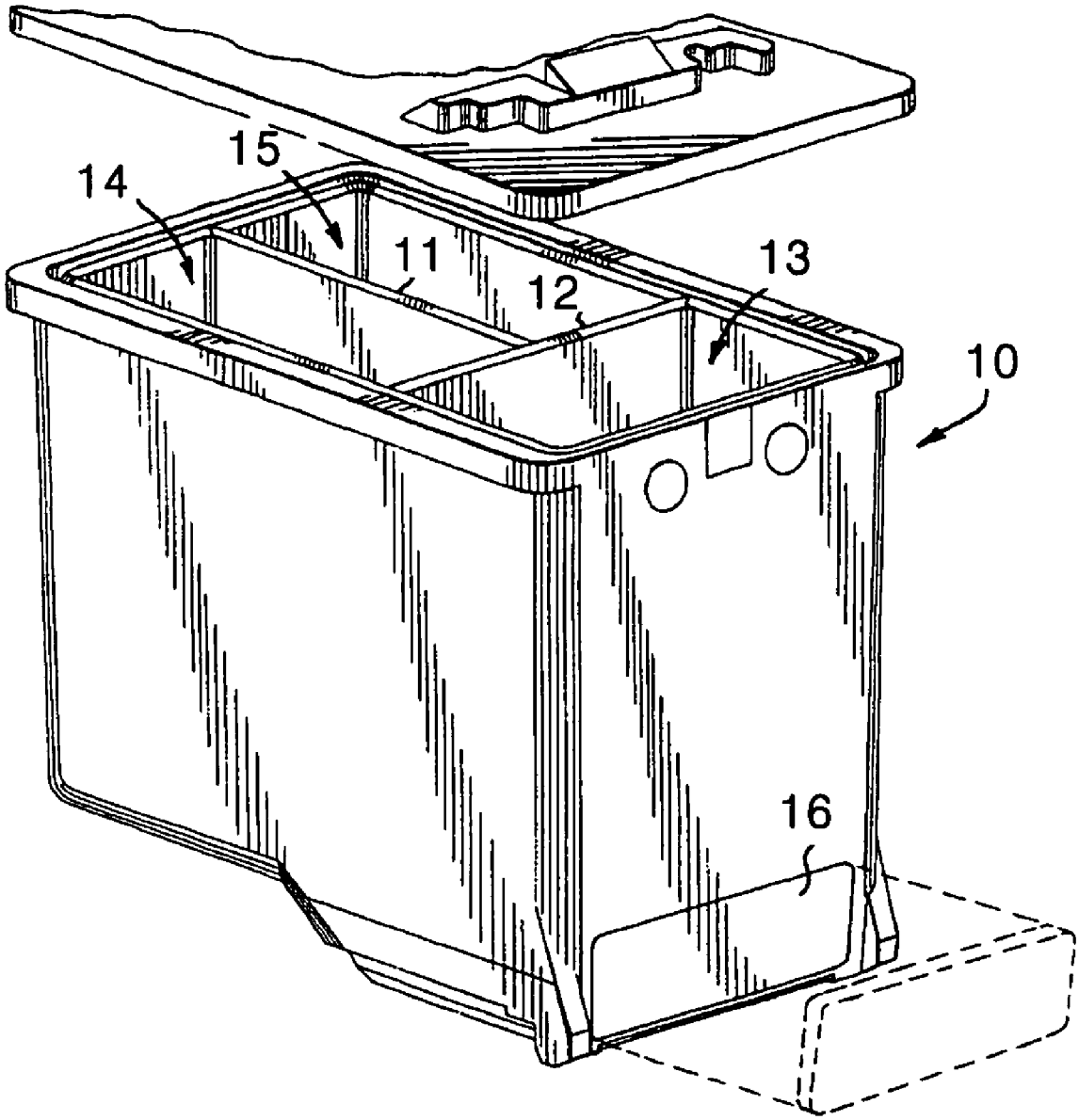
FIG. 1 (PRIOR ART)
FIG. 1 is a perspective view illustrating the structure of a conventional ink cartridge disclosed in U.S. Pat. No. 6,260,961.
Figure 2:
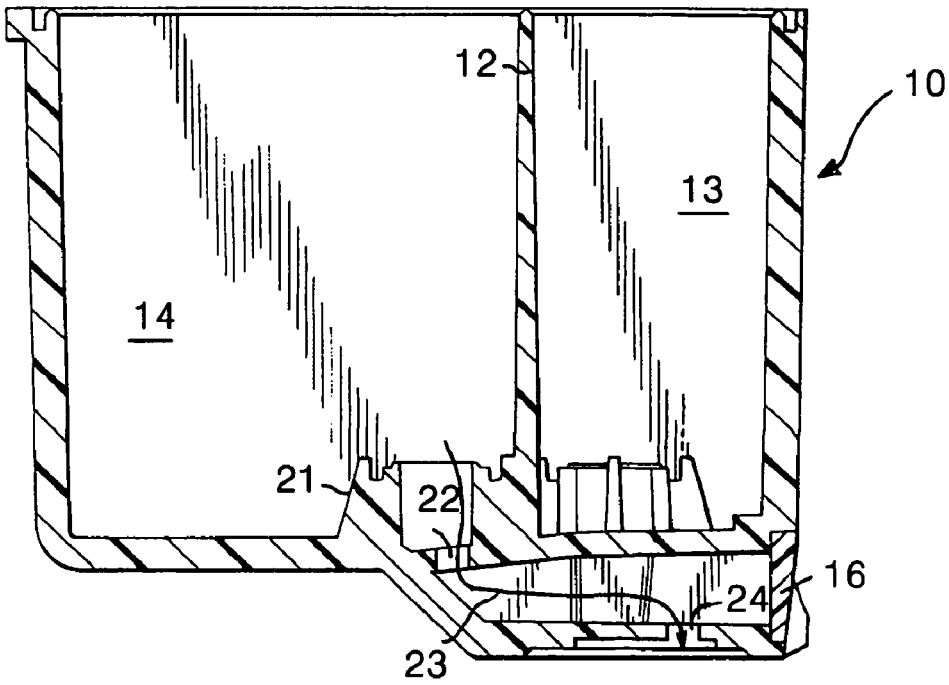
FIG. 2 (PRIOR ART)
FIG. 2 is a cross-sectional view illustrating the lower structure of a second or third chamber of FIG. 1.
Figure 3:
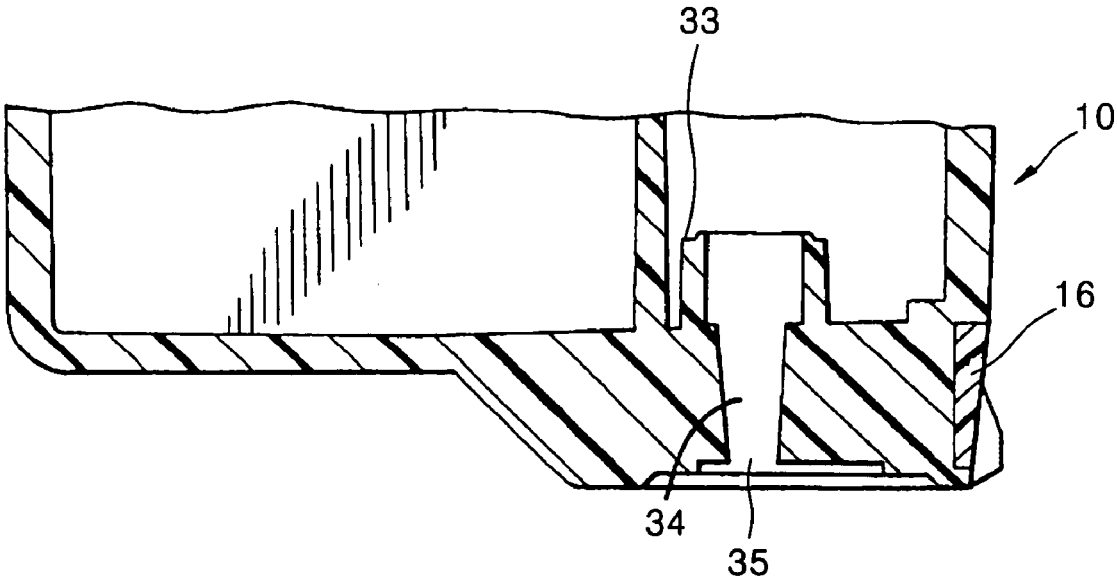
FIG. 3 (PRIOR ART)
FIG. 3 is a cross-sectional view illustrating the lower structure of a first chamber of FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures. The thicknesses of layers or regions shown in the drawings are exaggerated for clarity.

Figure 4:
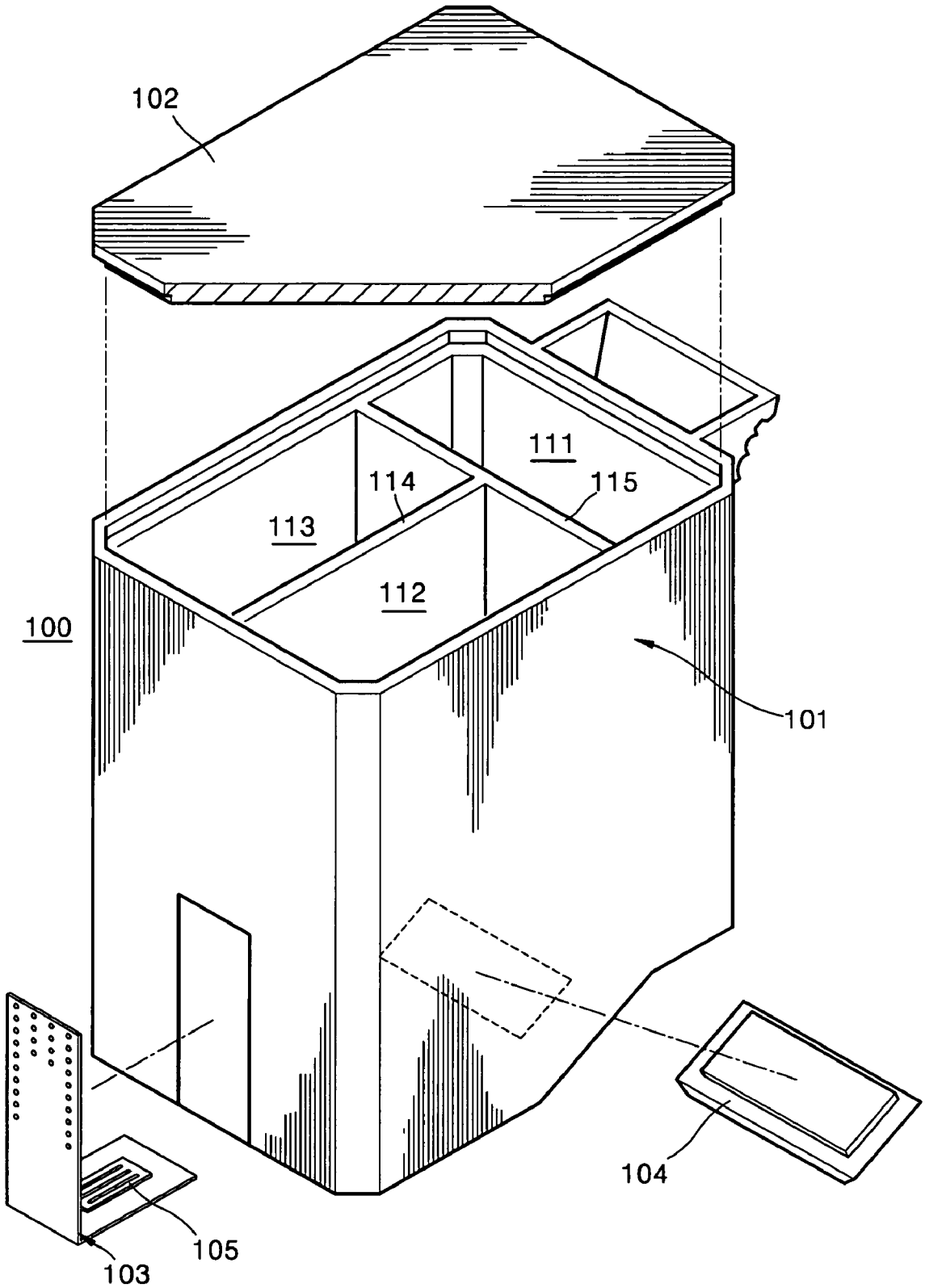
FIG. 4 is an exploded perspective view illustrating the structure of an ink cartridge for an ink-jet printer according to an embodiment of the present invention.

FIG. 4 is an exploded perspective view illustrating the structure of an ink cartridge for an ink-jet printer according to an embodiment of the present invention. Referring to FIG. 4, an ink cartridge 100 includes a body 101, a cover 102, and a flexible printed circuit (FPC) 103. The body 101 includes first, second, and third ink chambers 111, 112, and 113, in which ink is stored, formed in a unitary body. The cover 102 covers upper portions of the ink chambers 111, 112, and 113. The flexible printed circuit (FPC) 103 is attached on a front surface and a lower portion of the body 101, and transmits an electrical signal to a printhead 105. The printhead 105 includes a nozzle plate in which nozzles, through which ink is ejected in the shape of droplets, are arranged. After the body 101 is injection molded as a unitary body, one sealing member 104, which seals an opening for a side core used to form an ink flow path including an ink channel, is attached to the lower portion of the body 101 by adhesive or by ultrasonic welding.

The body 101 includes two interior walls 114 and 115. The two interior walls 114 and 115 form a "T" to define three ink compartments, i.e., the first, second, and third ink chambers 111, 112, and 113. A foam member (not shown) such as a sponge is filled in each of the first, second, and third ink chambers 111, 112, and 113, and ink of a predetermined color is stored at pores in the foam member. The foam member creates a predetermined negative pressure in the first, second, and third ink chambers 111, 112, and 113 through a capillary force.

Figure 5:
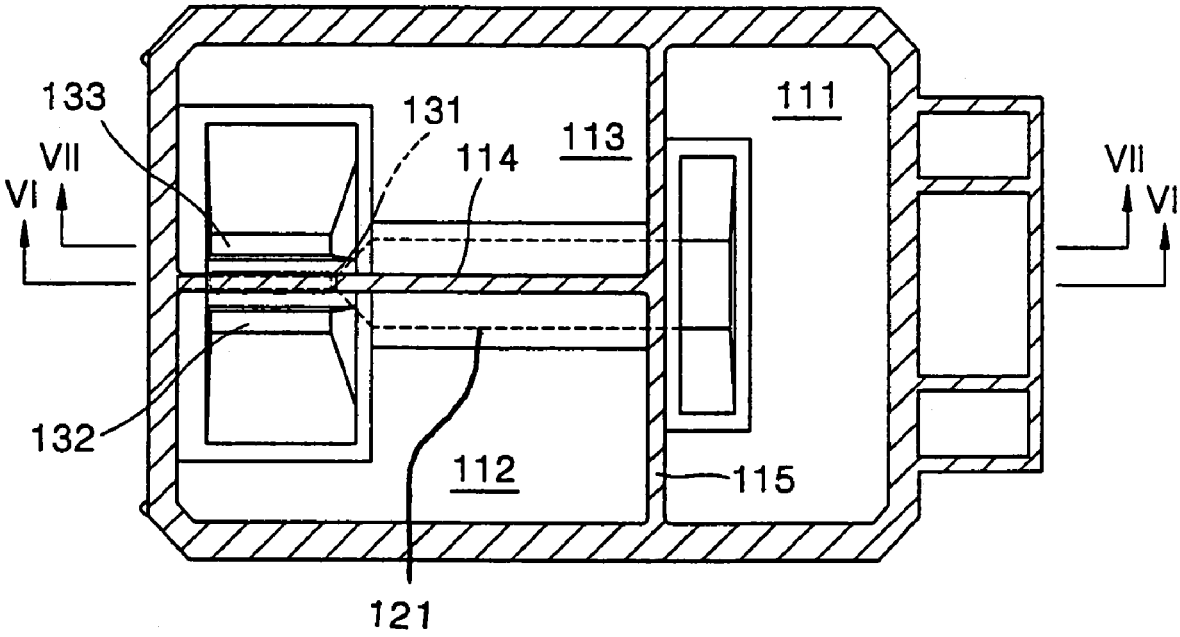
FIG. 5 is a plan view illustrating a body of the ink cartridge of FIG. 4.

FIG. 5 is a plan view illustrating a body of the ink cartridge of FIG. 4, and shows the bottom structure of the three ink chambers 111, 112, and 113, and interior walls 114 and 115.

The three ink chambers 111, 112, and 113 include the second and third chambers 112 and 113 parallel to each other and separated by the interior wall 114, and the first chamber 111 perpendicular to the second and third chambers 112 and 113. A foam member is embedded in each of the first, second, and third chambers 111, 112, and 113 as a negative pressure maintenance device. The printhead 105, which ejects ink droplets on paper, is disposed under the second and third chambers 112 and 113. In FIG. 5, an ink channel 121 is disposed from the lower portion of the first chamber 111 toward the printhead 105. An ink feed outlet 131, to which ink is supplied from the ink channel 121 to the printhead 105, is disposed between the second and third chambers 112 and 113. Ink feed outlets 132 and 133, to which ink is supplied from the second and third chambers 112 and 113, are disposed on both sides of the ink feed outlet 131. Thus, in the ink cartridge 100 according to an embodiment of the present invention, only an ink channel connected to the printhead 105 from the first chamber 111 is slanted, and ink channels connected from the second and third chambers 112 and 113 to the printhead 105 are substantially vertically formed. Meanwhile, FIG. 5 illustrates a state where a filter, which will be described later, is not provided so as to show the lower structure of the ink chambers.

Figure 6:
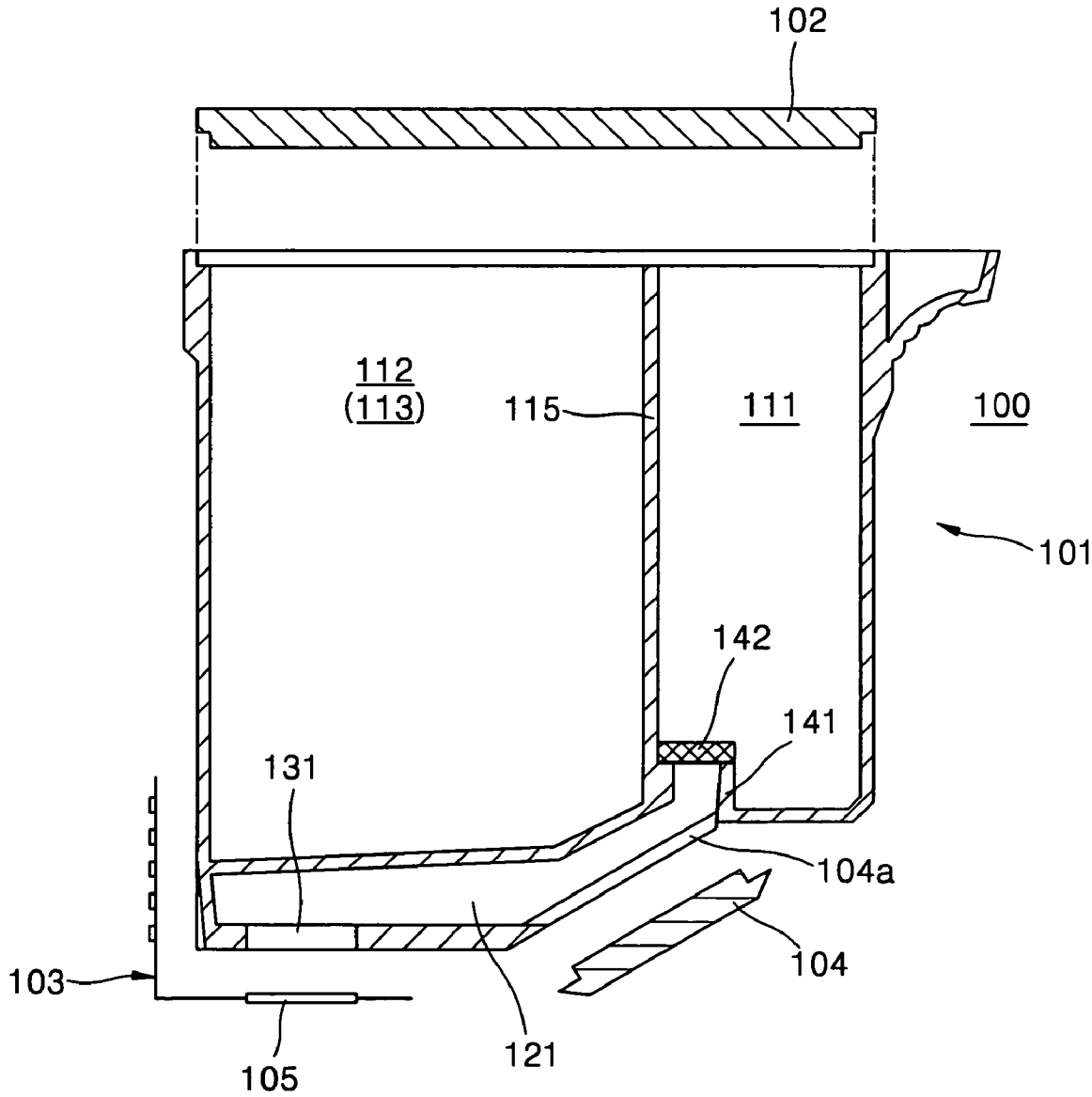
FIG. 6 is an exploded cross-sectional view taken along line VI-VI of FIG. 5.

FIG. 6 is an exploded cross-sectional view taken along line VI-VI of FIG. 5. A standpipe 141 is formed under the first chamber 111, and a filter 142, which filters impurity particles and air bubbles generated in the ink chamber 111, is installed on the standpipe 141. The sealing member 104 seals an opening 104*a* through which a side core is inserted into or removed from, and the side core is used to form the lower structure of the body 101, including the ink channel 121. Even when the sealing member 104 is not precisely bonded with the opening 104*a*, the sealing member 104 is disposed so as not to interfere with the FPC 103. Thus, the sealing member 104 does not affect the interconnection of the FPC 103 that enables an electrical signal to be applied to the printhead.

The ink channel 121 becomes narrower lengthwise so that the side core can be easily inserted into and removed from the ink channel 121. In the slanted ink channel 121, air bubbles that have flowed from the printhead 105, or were generated inside the ink channel 121, flow toward the opening 104*a*. Thus, the air bubbles do not disturb ink from flowing into the printhead 105.

Figure 7:
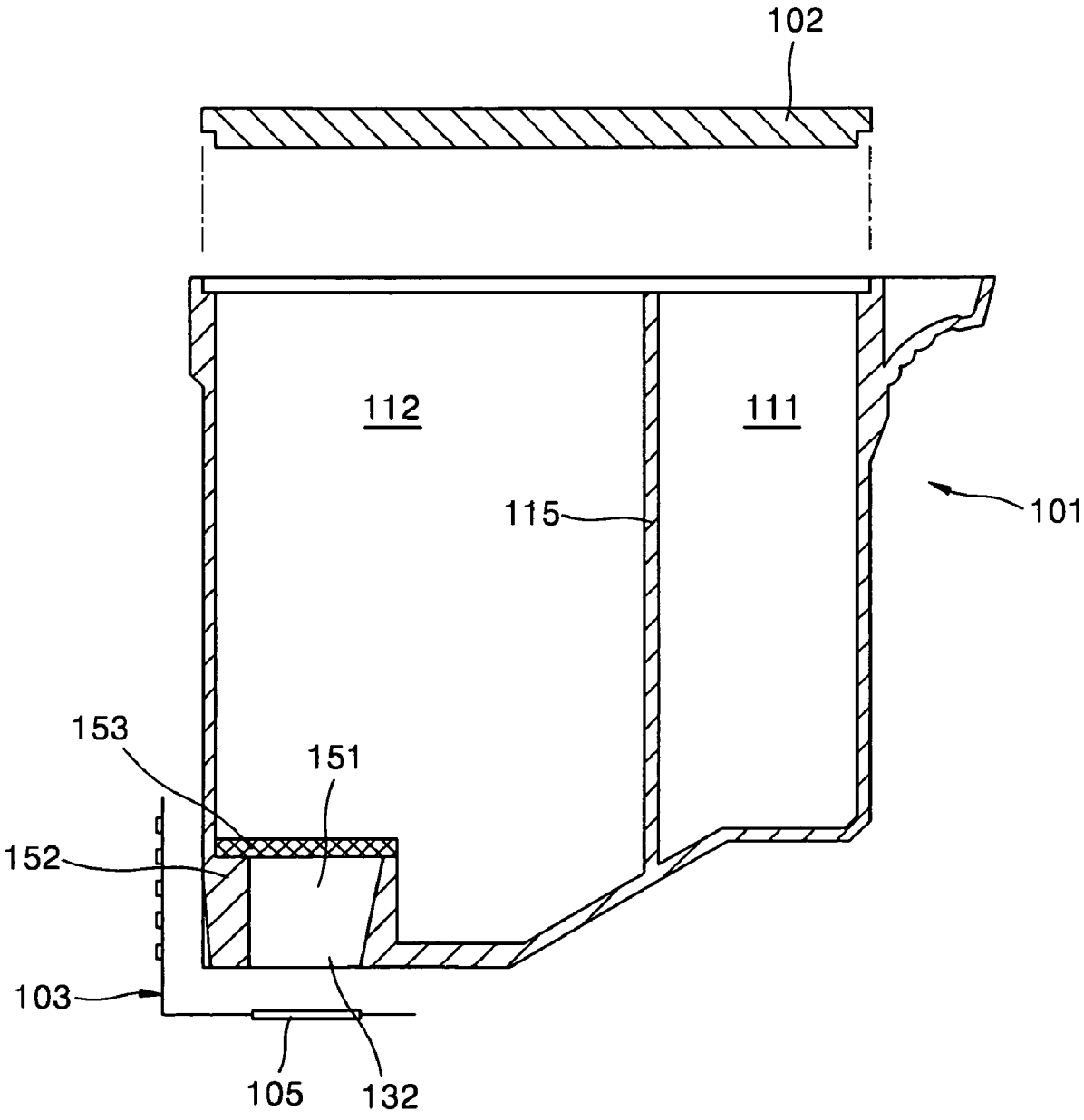
FIG. 7 is an exploded cross-sectional view taken along line VII-VII of FIG. 5.

FIG. 7 is an exploded cross-sectional view taken along line VII-VII of FIG. 5.

An ink channel 151, which supplies ink to the printhead 105, is formed under the second chamber 112 by the standpipe 152. The ink channel 151 has a vertical shape, and an ink feed outlet 132, which supplies ink to the printhead 105, is formed under the ink channel 151. A filter 153 is disposed on the standpipe 152.

As described above, the ink cartridge for an ink-jet printer according to the present invention is formed as a unitary body by injection molding. In the ink cartridge for an ink-jet printer according to the present invention, only an ink channel connected from a first chamber to a printhead is separated from the printhead, and ink channels connected from the other chambers to the printhead have a vertical structure. As a result, the ink cartridge for an ink-jet printer according to the present invention has a simple lower structure compared to a lower structure of a conventional ink cartridge. Thus, it is easy to fabricate the ink cartridge.

In addition, since a sealing member to seal an opening for a side core is disposed on a lower rear side of the ink cartridge, where it does not interfere with a flexible printed circuit (FPC), misattachment of the sealing member does not affect the operation of the printhead.

Meanwhile, since the three ink channels connected to the printhead are formed to be separated from one another, and the sealing member seals only one ink channel, leaks between the ink channels do not occur. Thus, there is no danger of color mixture.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A multi-chamber ink cartridge for an ink-jet printer, the ink cartridge comprising:

a printhead to eject ink droplets on a printing medium;

a unitary body comprising:

first, second, and third ink chambers formed by "T"-shaped vertical walls in the unitary body, each wall having a height such that a top portion of the unitary body, based on the height, is covered when enclosing the ink chambers, and each wall having a length in a direction different from the height, and first, second and third ink channels respectively provided from a lower portion of each of the ink chambers to an outlet at the printhead to supply ink to the printhead; and a flexible printed circuit to apply an electrical signal to nozzles of the printhead;

wherein the first chamber is disposed perpendicular to the second and the third chamber, and the printhead is disposed on a lower portion of the unitary body vertically below the second and third chambers and not underneath the first ink chamber, and wherein the first ink channel is disposed parallel to a lengthwise direction of the second or third chamber.

2. The ink cartridge of claim 1, further comprising a cover to cover upper portions of the ink chambers.

3. The ink cartridge of claim 1, further comprising a foam member filled in each of the first, second, and third ink chambers.

4. The ink cartridge of claim 3, wherein the foam member provides a predetermined negative pressure in the first, second, and third ink chambers through a capillary force.

5. The ink cartridge of claim 1, further comprising first, second and third standpipes provided respectively under the first, second, and third ink chambers.

6. The ink cartridge of claim 5, further comprising first, second and third filters provided respectively on the first, second, and third standpipes to filter impurity particles and air bubbles generated in the first ink chamber.

7. The ink cartridge of claim 1, wherein the first ink channel extends from the lower portion of the first ink chamber toward the printhead.

8. The ink cartridge of claim 7, further comprising a first ink feed outlet to which ink is supplied from the first ink channel, disposed between the second and third ink chambers.

9. The ink cartridge of claim 8, further comprising second and third ink feed outlets, to which ink is supplied from the second and third chambers, disposed on both sides of the first ink feed outlet.

* * * * *